US005496132A

United States Patent [19]

Pelletier

[11] Patent Number: 5,496,132

[45] Date of Patent: Mar. 5, 1996

[54] VIBRATION CONTROLLER DESIGNED IN PARTICULAR FOR VIBRATING, TAMPING AND COMPACTING EQUIPMENT

[75] Inventor: Monsiour J. C. Pelletier, Roanne, France

[73] Assignee: Societe Materials Vincent Vaillant MVV S.A.

[21] Appl. No.: 142,320

[22] PCT Filed: May 22, 1992

[86] PCT No.: PCT/FR92/00459

§ 371 Date: May 6, 1994

§ 102(e) Date: May 6, 1994

[87] PCT Pub. No.: WO92/20467

PCT Pub. Date: Nov. 26, 1992

[30] Foreign Application Priority Data

May 22, 1991 [FR] France ..... 91 06353

[51] Int. Cl.[6] ..... B06B 1/16

[52] U.S. Cl. ..... 404/133.05; 425/456

[58] Field of Search ..... 404/133.05, 133.1, 404/133.2; 425/421, 424, 456; 175/49

[56] References Cited

U.S. PATENT DOCUMENTS 3,211,226 10/1965 Myers et al. .
4,161,216 7/1979 Amancharla .
4,372,384 2/1983 Kinney .
4,516,634 5/1985 Pitts .
4,540,051 9/1985 Schmuck et al. .
4,541,486 9/1985 Wetzel et al. .
4,624,311 11/1986 Goad .
4,669,539 6/1987 Barrington .
4,830,597 5/1989 Steir et al. ..... 425/456
4,856,591 8/1989 Donovan et al. .
4,858,691 8/1989 Ilfrey et al. .
4,915,172 4/1990 Donovan et al. .
4,951,750 8/1990 Wetzel et al. .
5,180,010 1/1993 Stout et al. .
5,217,077 6/1993 Hart .

*Primary Examiner*—William P. Neuder
*Attorney, Agent, or Firm*—Eckert Seamans Cherin & Mellott

[57] ABSTRACT

A vibration controller has a vibratory mechanism with a pulley assembly with four pulleys coupled in pairs on two shafts linked by two belts. The pulley assembly is mounted under a reception table or tables for products to be vibrated and compacted. The pulleys receive offcenter weights for forming an unbalance. The weights are placed only on a aliametric portion of the pulleys. The pulleys are mounted in pairs on the two shafts associated with an phase-shifting device that rotates certain pulleys with respect to each other to vary the relative orientation of the corresponding weights. According to this orientation one can obtain maximum, partial or minimum vibration, one of the shafts being driven by a motor unit.

21 Claims, 13 Drawing Sheets

VIBRATION CONTROLLER DESIGNED IN PARTICULAR FOR VIBRATING, TAMPING AND COMPACTING EQUIPMENT

The invention relates to vibrating and compacting equipment in particular for the concrete block manufacturing industry. It also relates to equipment used to tamp and compact materials using all types of vibration generator.

In a particular embodiment given merely by way of example, concrete block manufacturing consists of successively placing moulds to be filled with raw material on a vibrating platform, positioning the platform under a press so that the material in the moulds is compressed, the vibrating machine being installed under the platform allowing the combined squeezing and tamping of the grains of material.

However, the current state-of-the-art requires that the vibration generator be stopped to remove the pallet of processed products and place an empty mould on the platform, i.e. the driving means have to be shut down or switched off. These operations alone are time-consuming, not to mention the various adjustments to the drives which may ultimately cause wear or failure.

In other applications such as material tamping, the vibration generator is linked to rollers or cylinders bearing down on the material to be compacted. Such vibration generators are complex devices that are costly to use.

Vibration generators are also used on breaking and crushing equipment, likewise requiring many complex mechanisms.

The object of this invention was to design a device that would represent an improvement over state-of-the-art devices and permit the control of the vibration imparted to the machines and equipment used in various applications such as concrete block manufacturing, material tamping and material compacting and breaking.

As regards concrete block manufacturing, a further object was to design a device that would not require the shutting down or switching off of the vibration generator driving means and that would be suitable for any vibration machine used to manufacture or process products.

As regards material tamping machines equipped with rollers, cylinders or similar devices, a further object was to generate vibrations fully adjustable as to magnitude and direction as a function of the operating conditions of said rollers or cylinders.

According to a first aspect of the invention, the device controlling the vibrations imparted to machines of the type comprising a vibration generator equipped with pulleys featuring flyweights and rotated by drive shafts, is noteworthy in that the vibration mechanism consists of sets of twin pulleys linked by belts and designed to be equipped with flyweights fitted only to a diametric part thereof and in that said pulleys are mounted in pairs on two shafts which are connected to an oscillating phase-shift device designed to cause certain pulleys to rotate, thus changing the angular position of the corresponding flyweights, and generate, depending upon the positions required and selected, maximum, partial or no vibration with no unwanted torque, one of the shafts being driven by a motor running continuously regardless of the operating phase, and in that the vibrating weights can be in static and dynamic equilibrium when the vibrationless position is selected.

According to a further aspect, a first shaft has both keyed pulleys and idle pulleys and a second shaft has both keyed pulleys and idle pulleys, this being designed to form an alternating and opposed system of pulleys where each pair of pulleys linked by a belt consists of a keyed pulley on the shaft and an idle pulley on the shaft.

According to a further aspect, the device is applicable to concrete block manufacturing.

According to a further aspect, the device is applicable to material tamping machines equipped with vibrating rollers or cylinders.

According to a further aspect, the device is applicable to breaking and crushing machines.

These aspects and others will become apparent from the following description.

The object of the present invention is described, merely by way of example, in the accompanying drawings in which.

In order that the present invention may more readily be understood, the following description is given, merely by way of example, reference being made to the accompanying drawings.

The device according to the invention is widely applicable to manufacturing processes involving compacting such as concrete blocks, material tamping equipment using rollers or cylinders and breaking and crushing machinery.

The various applications of the device defined by the same means shall be described in turn.

Figure 1:
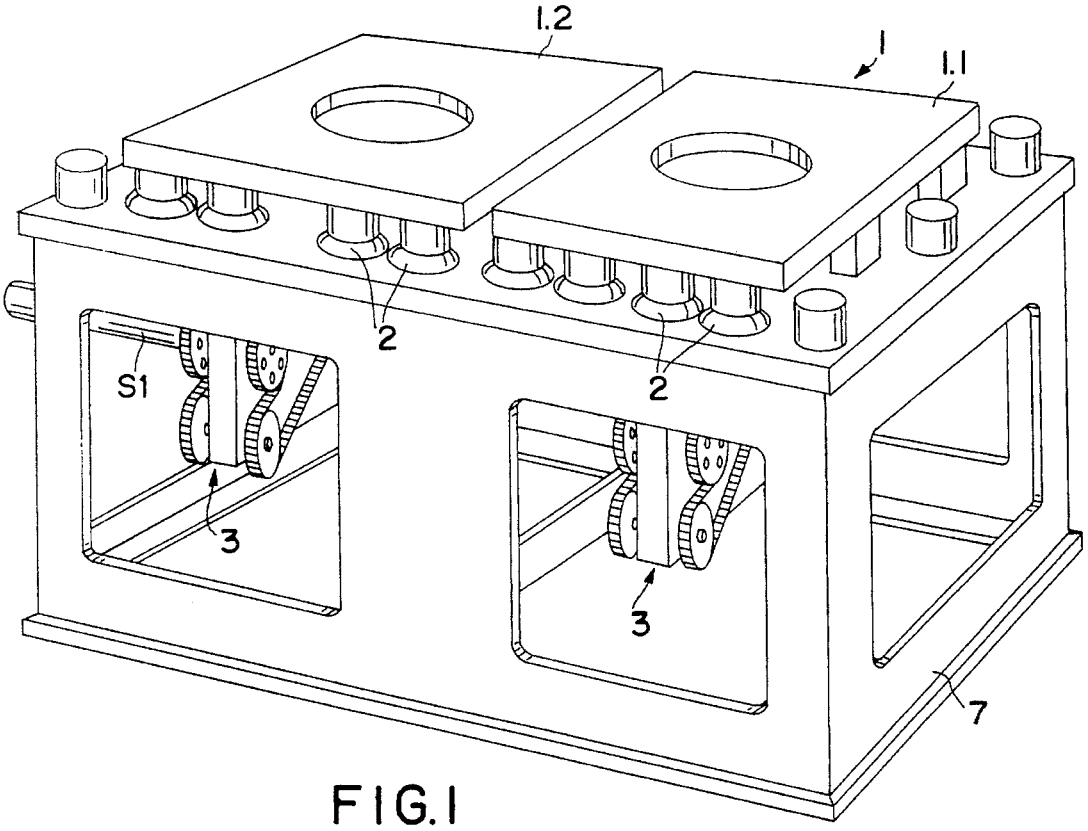
FIG. 1 is a schematic perspective view of the device according to the invention applied to, for example, machines and equipment used in concrete block manufacturing.

Looking at FIG. 1, the device according to the invention can advantageously be applied to machinery used to manufacture concrete blocks, it being understood that the device is equally suitable for other applications.

As applied to concrete block manufacturing, the device shown comprises a platform (1) resting on vibration dampers (2) of the silent-bloc type mounted on top of a supporting frame (7). This frame can accommodate one, two or more separately driven platforms operating in a fully synchronized manner. The vibration controller generally designated as (3) is installed under the platform or each of the platforms. A mould (4) is placed on the platform or each of the platforms and filled with material (5) to be compacted by one or more presses (6).

The above-mentioned vibration machine imparts a vertical movement to the platform that, when countered by the vibration dampers, results in a reciprocating movement tamping the material in the mould.

To prevent repeated interruptions of concrete block manufacturing in order to change the moulds at the end of the compacting operation involving stopping the vibration generator or its driving means, a device is used that will be described hereafter with reference to the drawings.

The vibrating mechanism consists of one or more platforms on which are placed the moulds containing the concrete blocks or other material to be compacted and under which a pulley system (8–9, 10–11) is installed. The pulley system consists of sets of twin, belt-linked pulleys designed to be equipped with flyweights (12) placed so as to cause unbalance and consequently vibration when in rotation. The flyweights are only placed on a diametric part of the pulleys, and, more precisely, on less than the semicircular half of their circumference.

In one embodiment, said pulleys are designed with a plurality of radially and evenly distributed holes (8.1, 9.1, 10.1, 11.1), into some of which a lead or other flyweight is placed. All pulleys are toothed and linked in pairs by a toothed belt (13), with a tensioning roller (14) taking up the slack.

Figure 3:
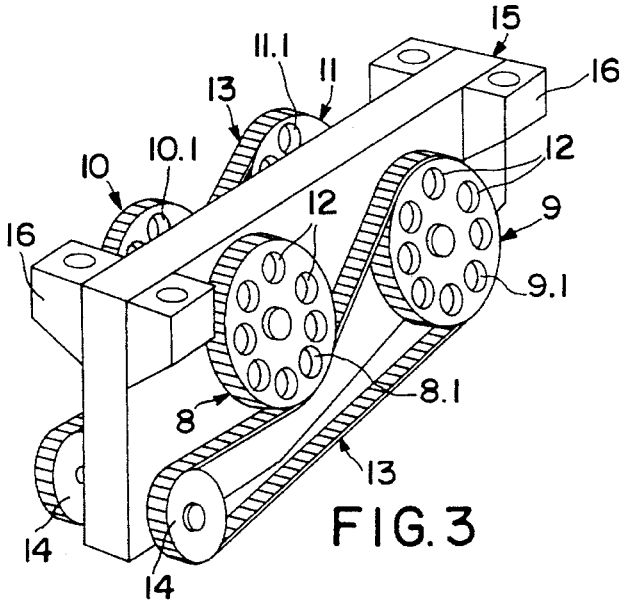
FIG. 3 is a detail of FIG. 2 showing pulley and complementary flyweight supports.
Figure 2:
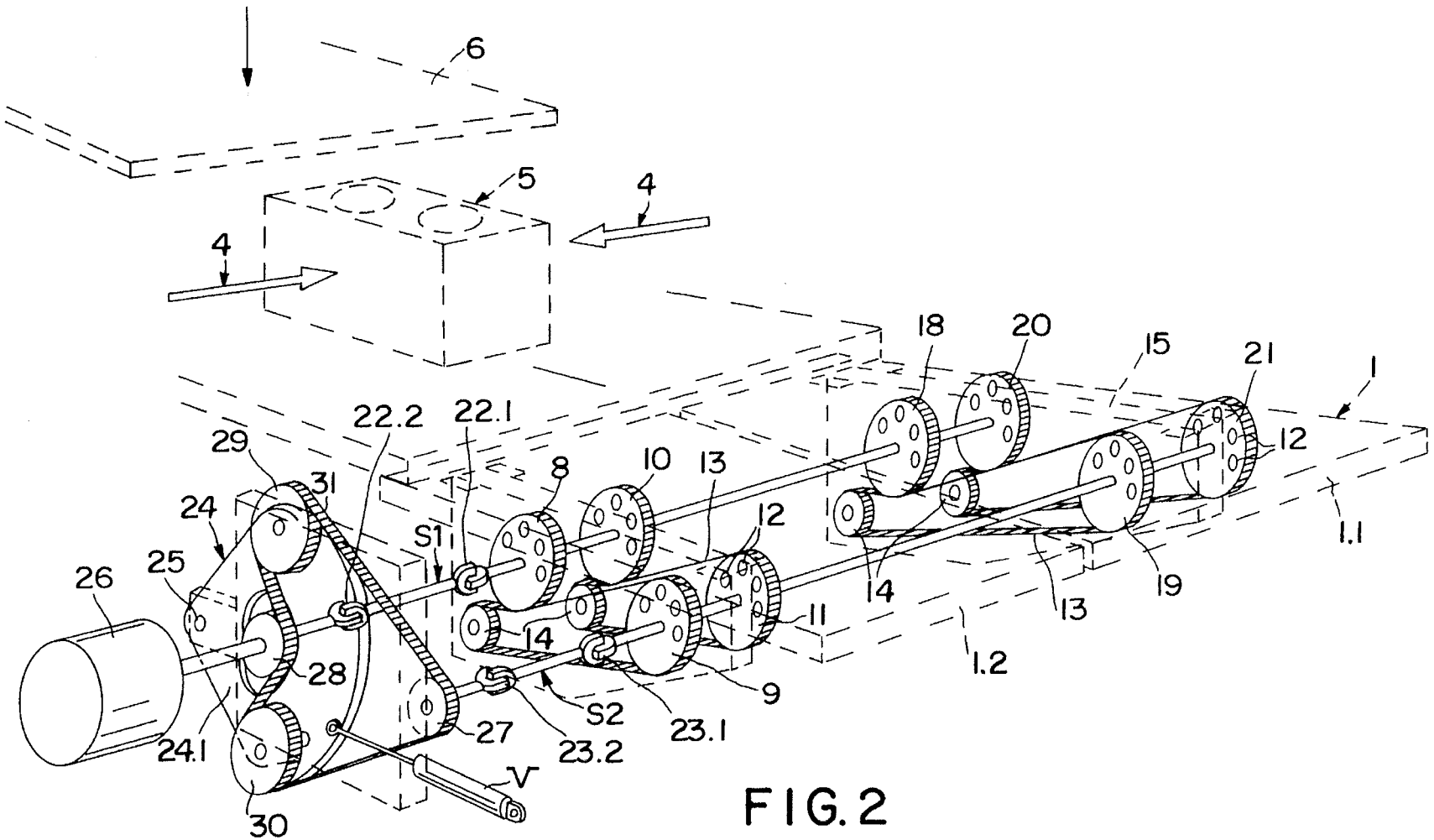
FIG. 2 is a schematic pre-assembly drawing showing the various means of the device according to the invention allowing the phases of the drive shafts (S1–S2) to be shifted.

FIGS. 2 and 3 show the pulleys mounted onto a support (15) installed crosswise in a frame (7). Each of the supports has a parallelepipedal shape and is designed with holes for shafts of said pulleys and the roller connected to each pair of pulleys. A twin pulley and roller set is mounted on either side of the support. The support top is equipped with mounting brackets or lugs (16) to attach it by any means to the lower part of the platform.

As is apparent from the drawings, pulleys (8, 9, 10 and 11) are mounted twinned (8–10, 9–11) on each of the two shafts (S1 and S2), which are coupled to a phase-shift device designed to cause partial rotation of certain pulleys, affecting the direction of the flyweight. Certain pulleys are keyed on their shafts (S1 and S2), while others are idle on said shafts, causing rotation in opposite directions.

Figure 4:
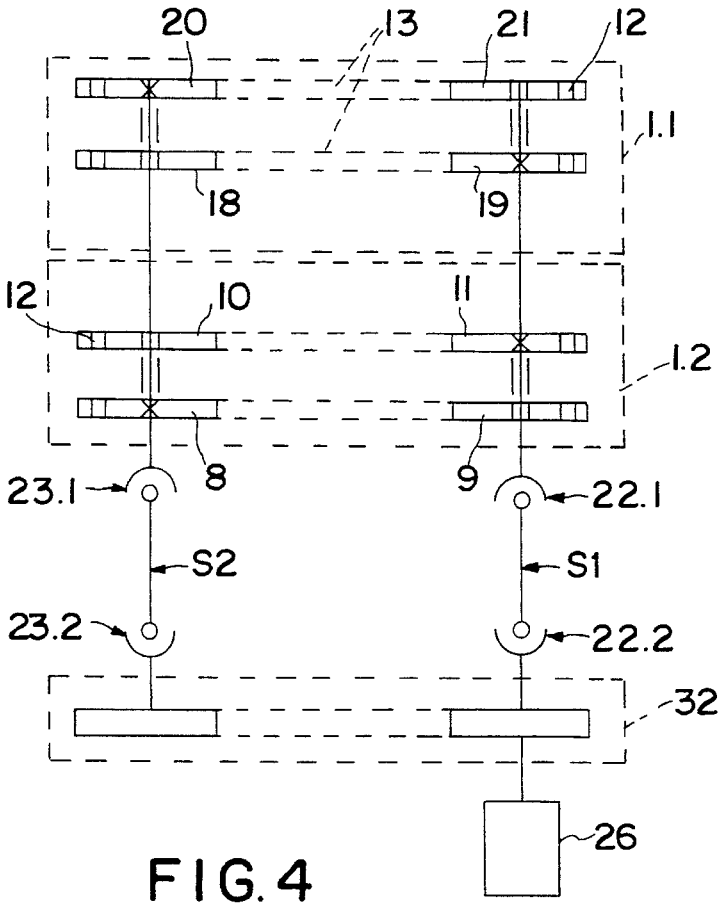
FIG. 4 is a schematic top view showing the links between the vibration device and the phase-shift device, shafts (S1–S2) rotating in opposite directions.

Looking at FIG. 4, which notably illustrates the use of two platforms (1.1 and 1.2), twin pulley units (8–9, 10–11) are used for the first platform and twin pulley units (18–19, 20–21) are used for the second platform. Pulleys (8 and 20) are keyed on shaft (S2), pulleys (11 and 19) are keyed on shaft (S1), while pulleys (10 and 18) are idle on shaft (S2) as are pulleys (9 and 21) on shaft (S1).

In FIG. 4, the flyweights on each pulley are in the same plane to ensure the vibration effect is the same for the above-mentioned platform(s) when the material is tamped; shafts (S1 and S2) are rotating in opposite directions.

To stop the system from vibrating, the flyweights on certain pulleys need to be diametrically opposite, as is apparent from the following drawings.

Figure 5:
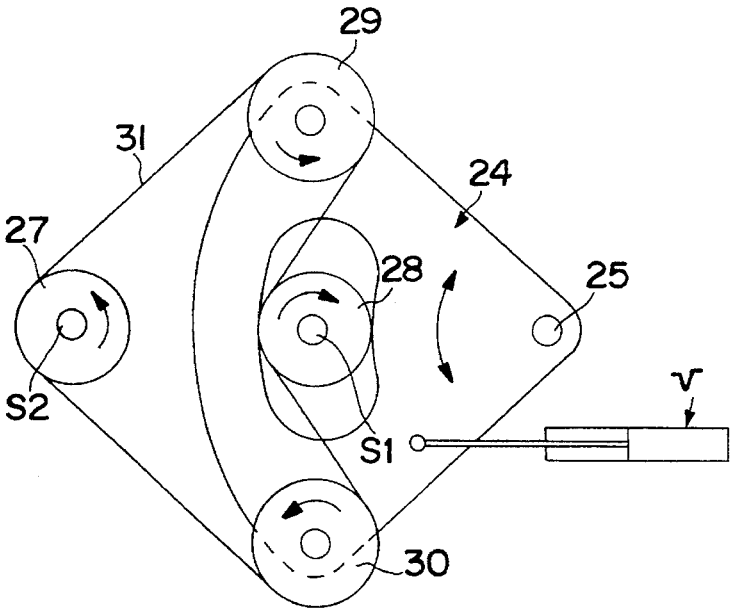
FIG. 5 is a detail of a first embodiment showing the phase-shift device of shafts (S1 and S2).

To achieve this, shafts (S1 and S2) need to be adjusted so as to cause a mechanical phase-shift during rotation. The required phase-shift is obtained with an oscillating phase-shift device coupled to shafts (S1 and S2). One possible assembly is illustrated in FIG. 5.

The phase-shift device installed outside the frame onto which the platform(s) are mounted comprises shafts that can be coupled by any additional coupling means such as ball-and-socket couplings (22.1, 22.2–23.1–23.2) to drive shafts (S1 and S2). Thus, drive shafts (S1 and S2) or their extension shafts, also designated (S1 and S2) to avoid confusion, run in a double flange unit (24) pivoting at point (25) with regard to the housing of the above-mentioned phase-shift device. Drive shaft (S1) is coupled to a driver (26) ensuring the continuous operation of the system.

The double flange unit (24) comprises two triangular flanges (24.1–24.2) reinforced with cross-braces. Also running in the double flange unit and located roughly at its two corners are rollers (29 and 30). The double flange unit itself pivots around shaft (25), both ends of which are attached transversely to a protective housing of the phase-shift device. The flanges are spaced to accommodate a fixed pulley (28) mounted onto drive shaft (S1). The flanges feature an oblong slot (24.3) accommodating said pulley during the oscillation of said double flange unit as explained hereafter. Another pulley (27) is mounted on shaft (S2) in line with pulley (28) and on the outside of the pivoting structure, said pulleys (27–28) being fixed in place on their respective shafts. Thus, the two rollers (29–30) are arranged on each side of the line defined by pulleys (27 and 28). Pulley (27) is mounted outside the double flange unit.

A toothed belt (31) links pulleys (27 and 28) and rollers (29 and 30) as shown on the drawings.

The above-mentioned double flange unit can swing around the point constituted by shaft (25) which does not lie in the plane defined by the drive pulleys (27 and 28). Said unit is mounted inside the protective housing (32) of the vibration controller.

It should be emphasized here that the position of shaft (25) is advantageously predetermined and fixed so that the width of the belt (31) remains constant. Furthermore, the design of the double flange unit (24) is such that, contrary to the prior art, no tensioning rollers are required.

Figure 21:
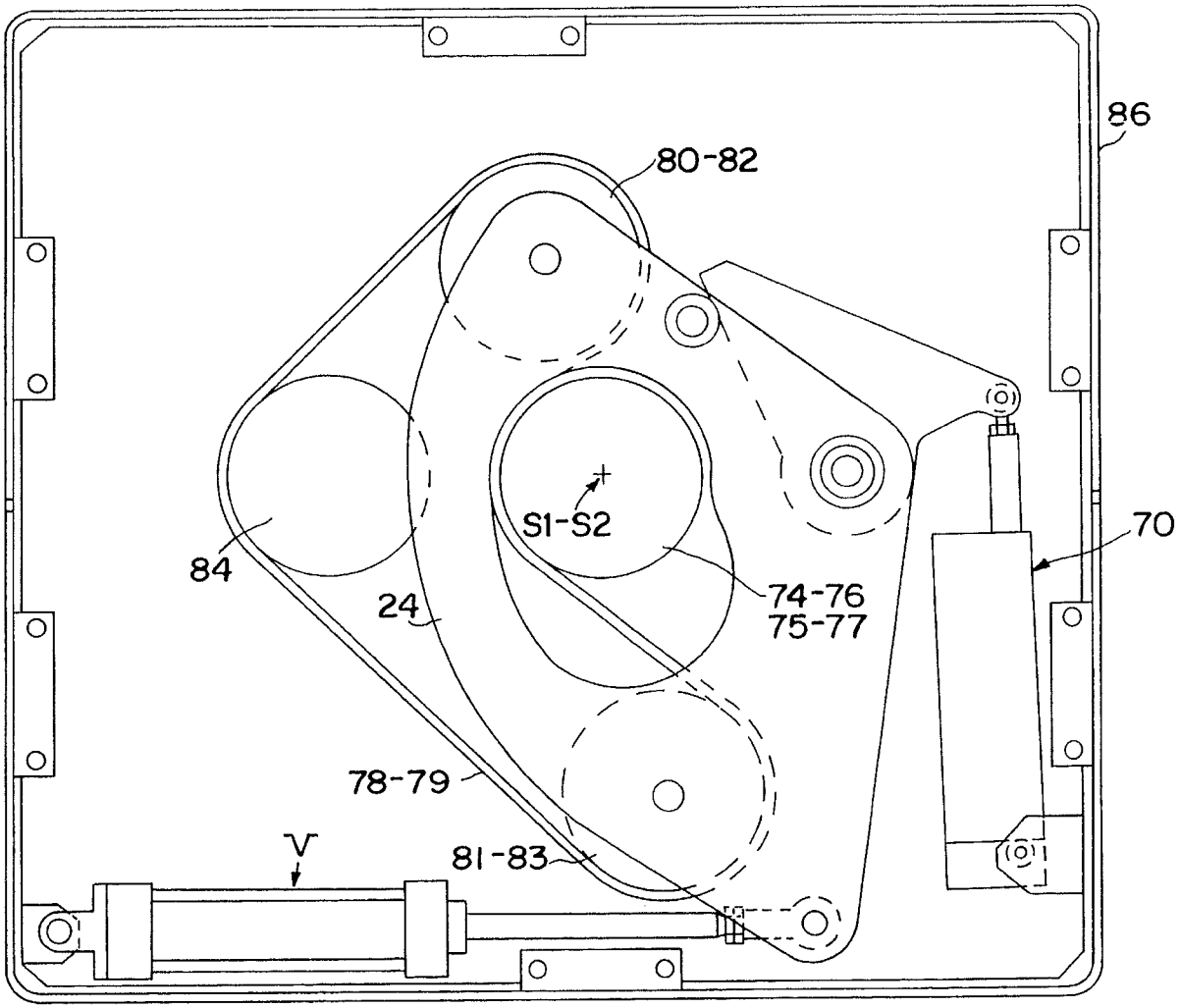
FIG. 21 is a side view of the oscillating phase-shift device mounted in a housing.
Figure 22:
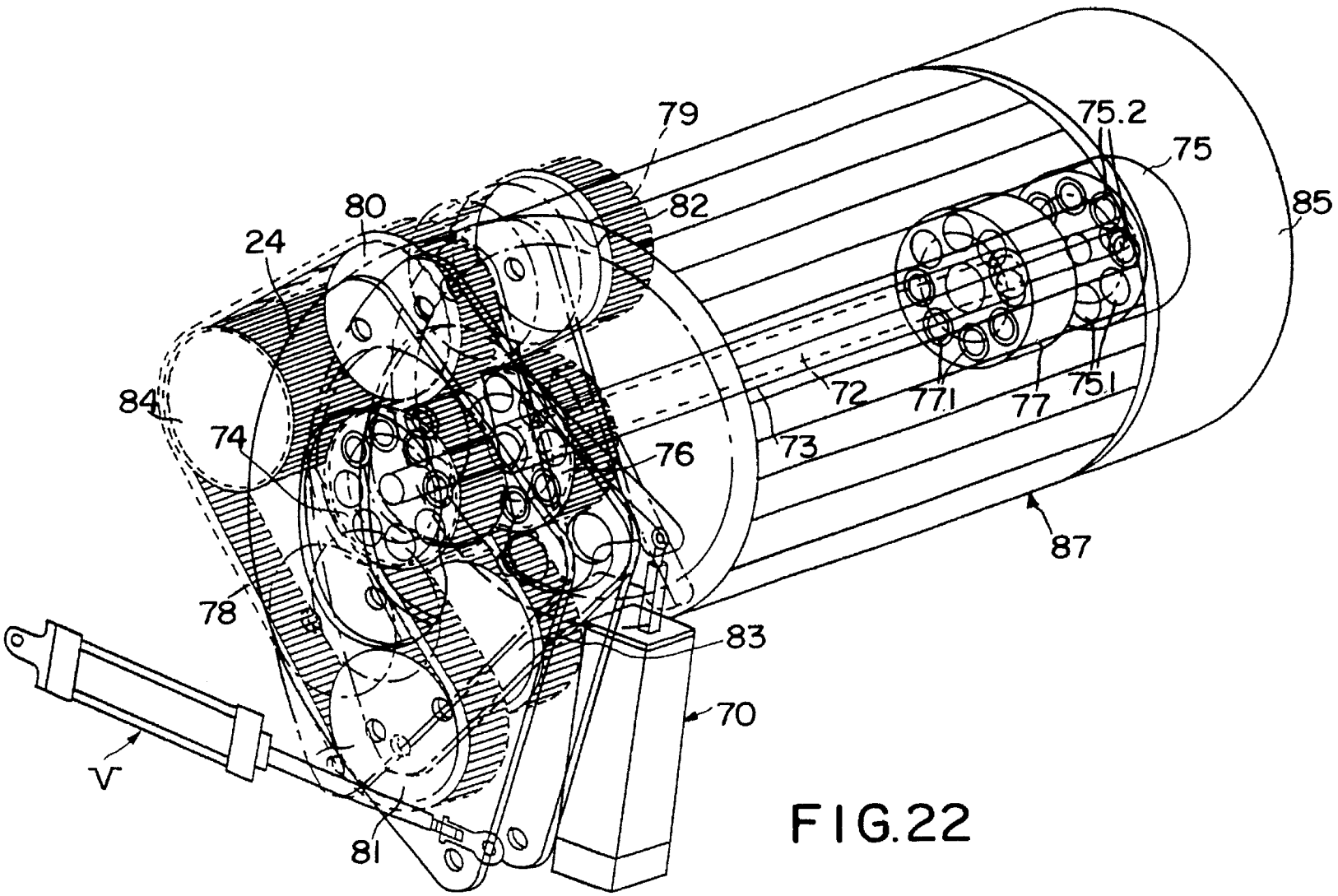
FIG. 22 is a perspective view of the device according to the invention as applied to a tamping roller or cylinder.
Figure 23:
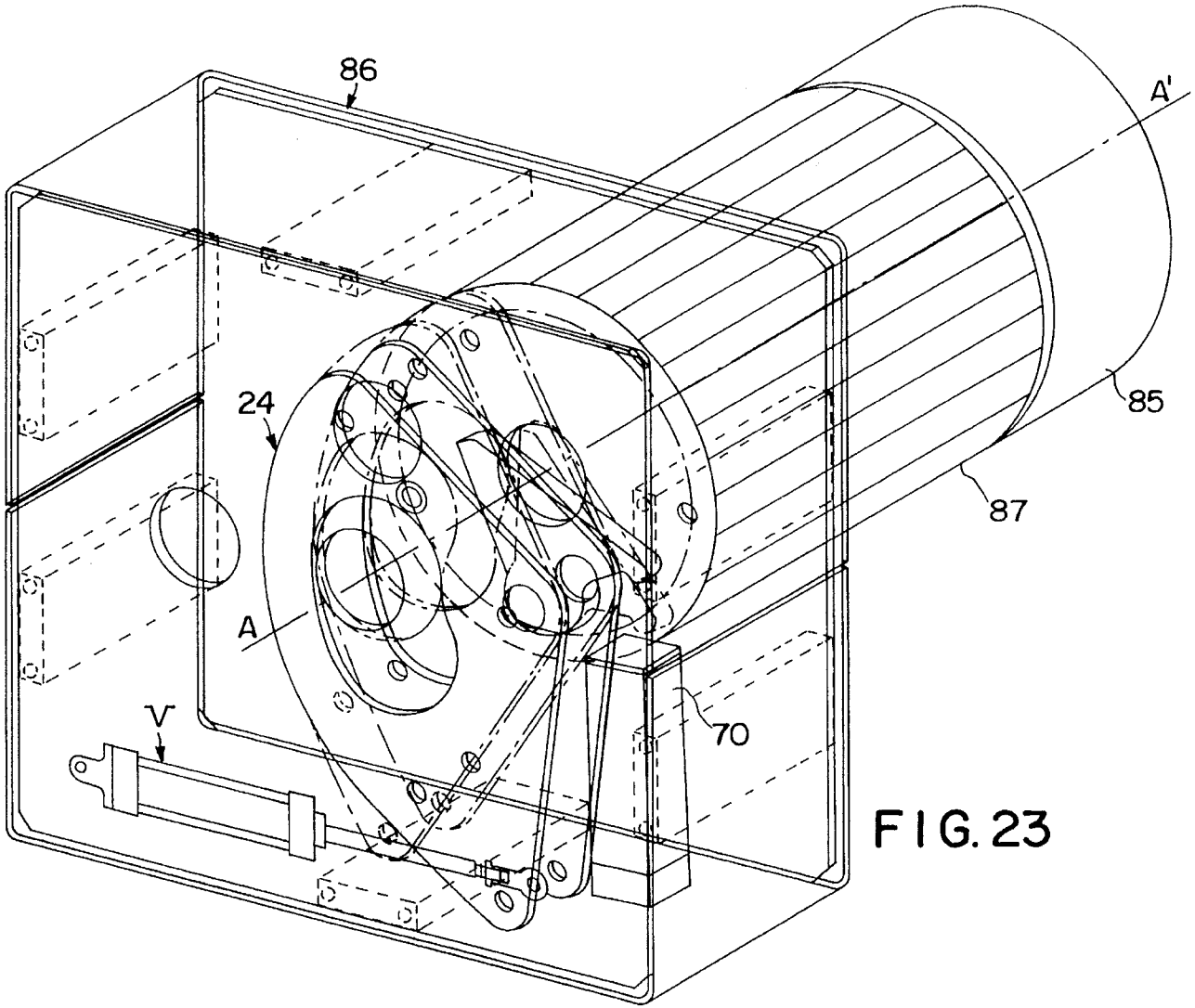
FIG. 23 is a view according to FIG. 22 showing the above-mentioned oscillating phase-shift device enclosed in a protective housing.
Figure 24:
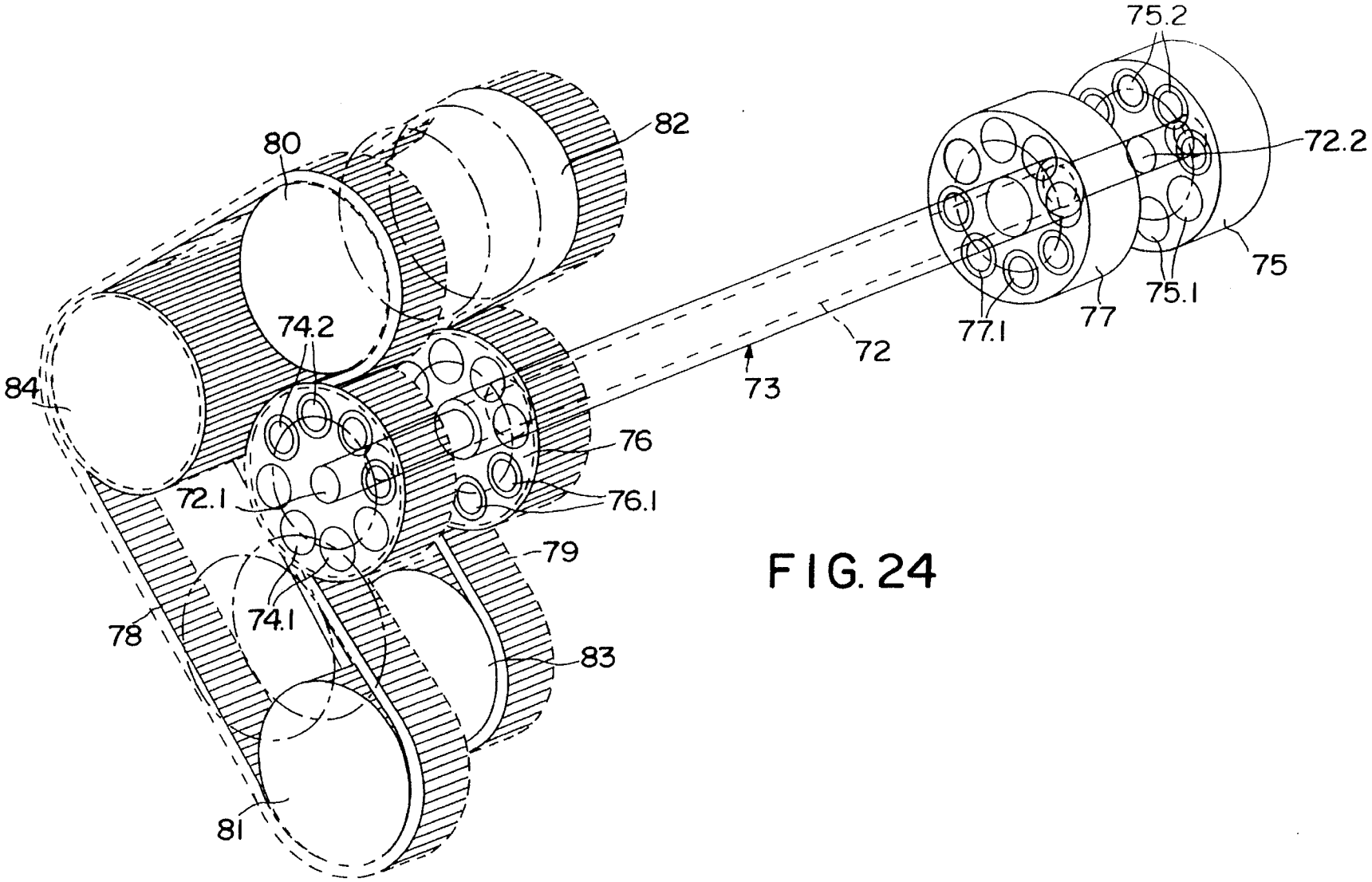
FIG. 24 is a detail of FIG. 16 showing the vibration machine and the oscillating phase-shift device in the same plane.
Figure 25:
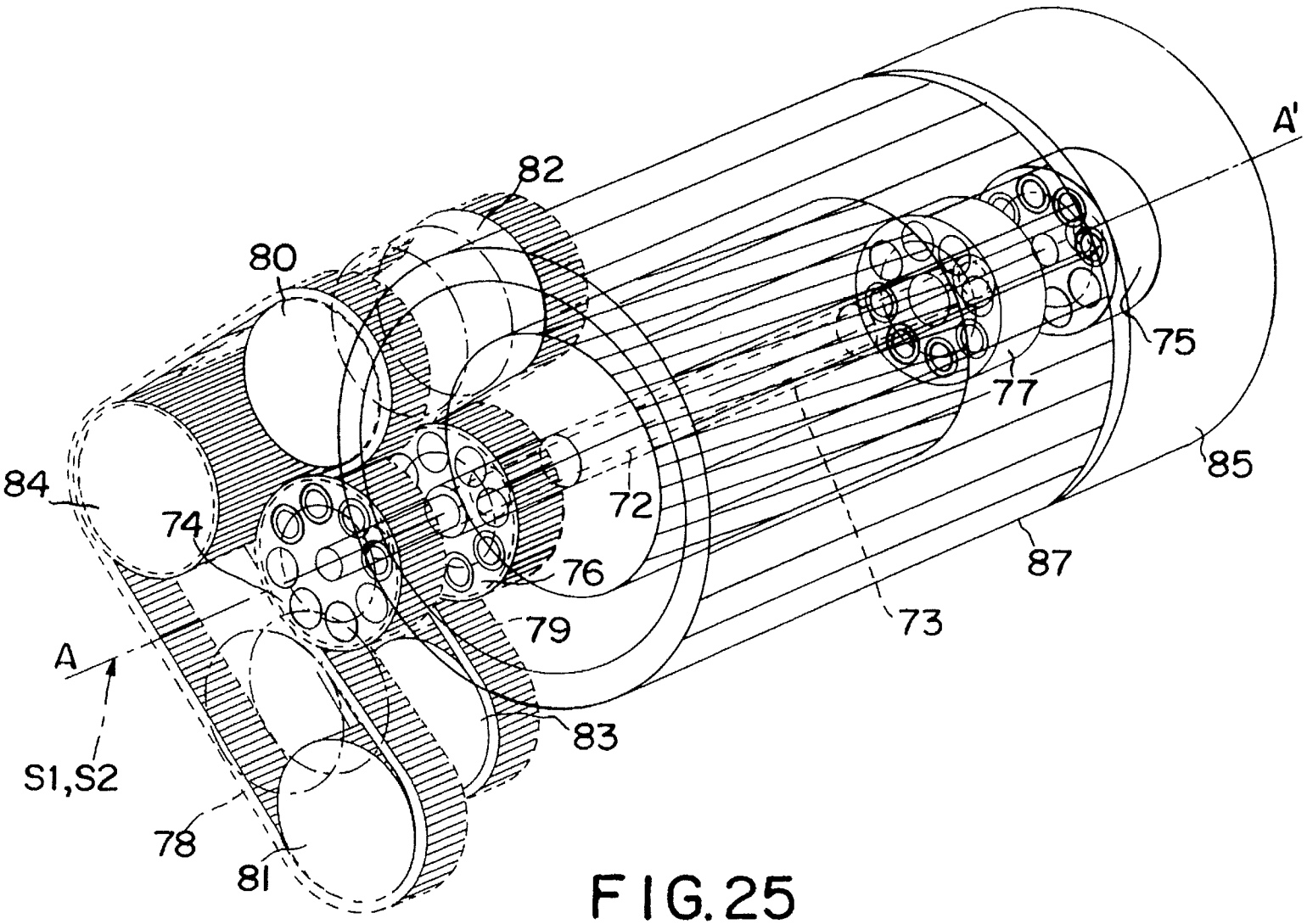
FIG. 25 is a complementary view to FIGS. 22 to 24, showing the complete device.

The double flange unit can be positioned at a certain number of angles by, for example, a jack (V) mounted on the above-mentioned housing. The jack rod is fastened to one of the above-mentioned flanges. An adjustable stop (68) limits and preselects the phase-shift angle. As shown in FIG. 21, such a stop might be a cross-mounted rod (69) between the flanges (24.1 –24.2), said stop being linked to a profiled part (70) hingedly mounted with regard to the double flange unit (24) and, advantageously, about its rotational axis (25). The profiled part is moved by a jack (71) mounted onto the protective housing (32). The stroke of the rod (71.1) of the jack (71) defines the maximum angle of swing of the double flange unit (24) and hence the maximum phase-shift.

It now is apparent that the flange unit's angle of swing affects the position of pulleys (27 and 28)—hence the phase-shift between shafts (S1 and S2). Thus, advantageously, oscillating the double flange unit at an angle of plus or minus 12.75° will cause a phase-shift angle of 180° and shafts (S1 and S2) to rotate in opposite directions.

Figure 6:
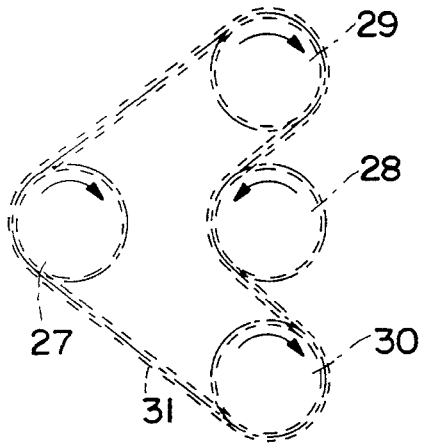
FIGS. 6, 7 and 8 are views according to FIG. 5, illustrating the various positions of the phase-shift device with shafts (S1 and S2) rotating in opposite directions.
Figure 7:
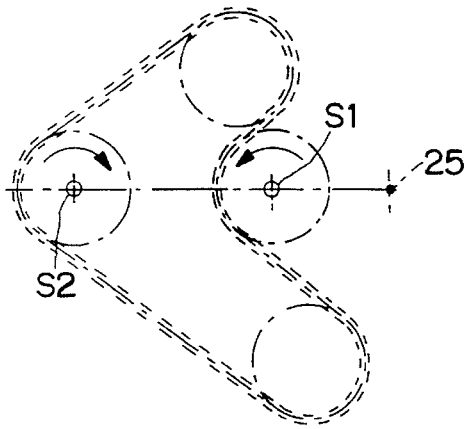
Figure 8:
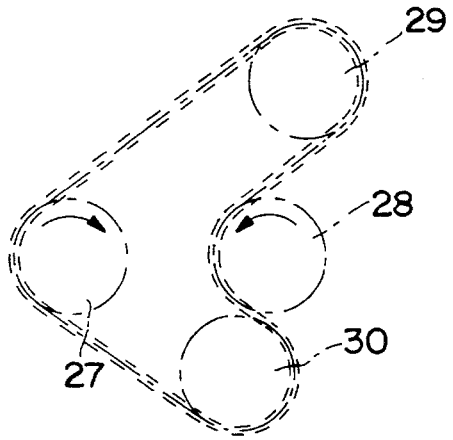

FIGS. 6, 7 and 8 show the various pulley positions as a function of double flange unit angle.

It follows from FIG. 4 that any adjustment of drive shaft (S1) will cause pulleys (11 and 19), both keyed on their shafts, to partially rotate so that the flyweights on these pulleys will swing 180°, taking positions diametrically opposed to those of the flyweights of pulleys (9 and 21). Belt-driven, pulleys (10 and 18) will react the same way, their flyweights taking up a position diametrically opposed to those of pulleys (8 and 20). The system thus balanced imparts no vibrations to the concrete block or other platforms and there is no unwanted torque. As there is no vibration, the flyweights are statically and dynamically balanced.

FIGS. 9, 10, 11, 12, 13, 14 and 15 show the application of the above-mentioned vibration device when drive shafts (S1 and S2) rotate in the same direction.

Figure 9:
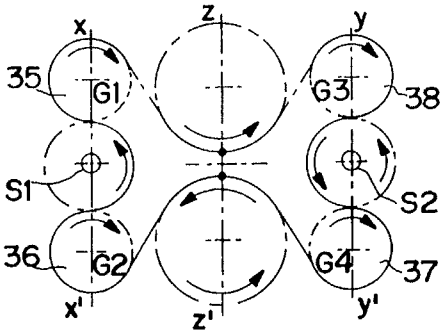
FIG. 9 is an alternative view of the phase-shift device with shafts (S1 and S2) rotating in the same direction.
Figure 11:
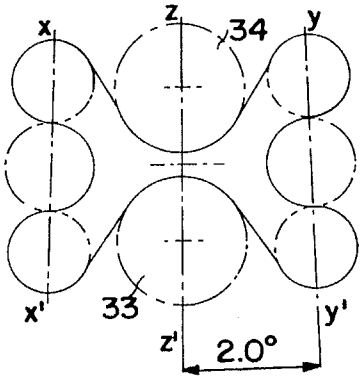
FIG. 11 is a similar view to FIG. 9 with shaft (S1) at a different angle to shaft (S2) and being in a phase-shift position.
Figure 13:
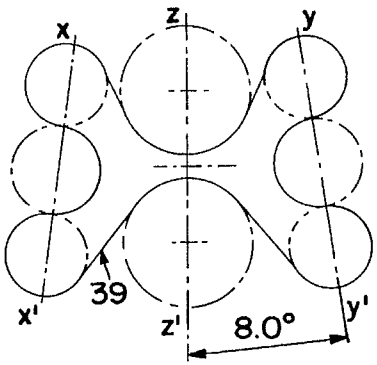
FIG. 13 is a similar view to FIG. 9 with shafts (S1 and S2) placed at an angle of 8°.
Figure 16:
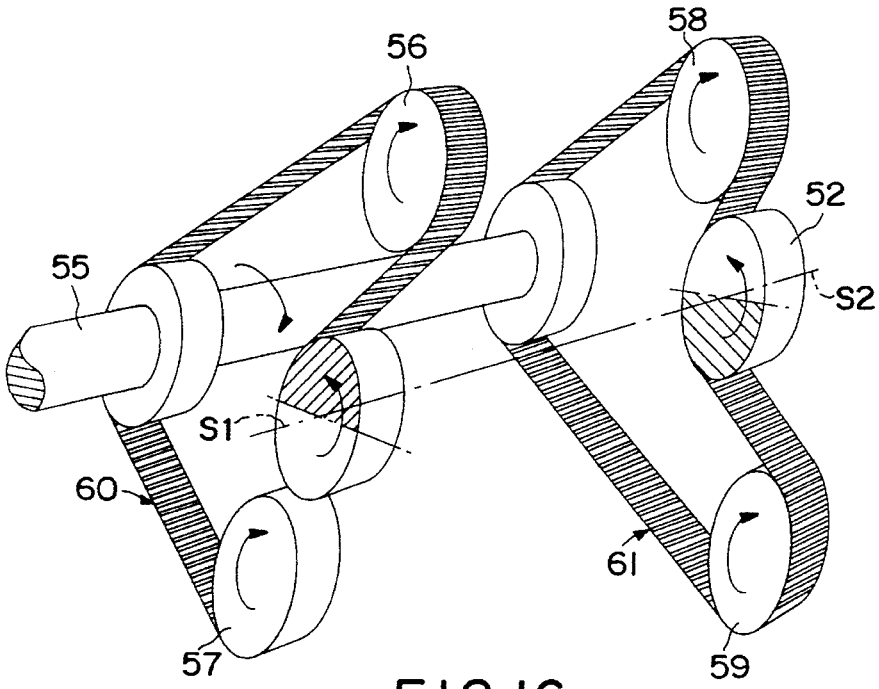
FIG. 16 is a perspective view showing two devices as illustrated in FIG. 6.

Besides drive shafts (S1 and S2), FIG. 9 shows a flyweight phase-shift system comprising a drive pulley (33), a tensioning roller (34) and four idle rollers (35, 36, 37, 38) equipped with a toothed belt (39). Rollers (35 and 36) are mounted in the same plane as drive shaft (S1) along an X–X' axis, whereas rollers (37 and 38) are mounted in the same plane as drive shaft (S2) along an Y–Y' axis.

Figure 15:
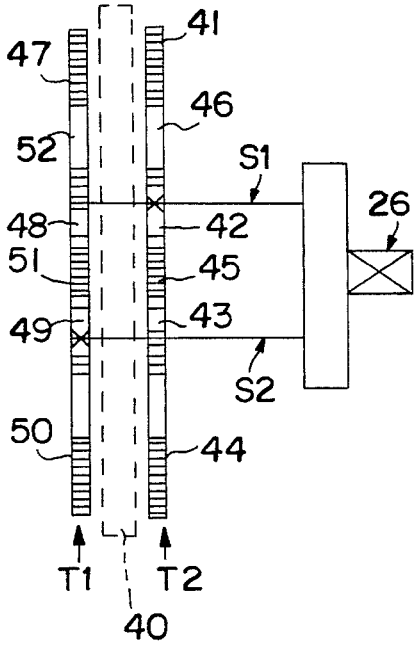
FIG. 15 is a schematic top view showing the relationship between the phase-shift device illustrated in FIGS. 9, 11 and 13 and the position of the flyweights depicted in FIGS. 10, 12 and 14.

FIG. 15 shows shafts (S1 and S2) driving two sets of pulleys (T1–T2).

Figure 10:
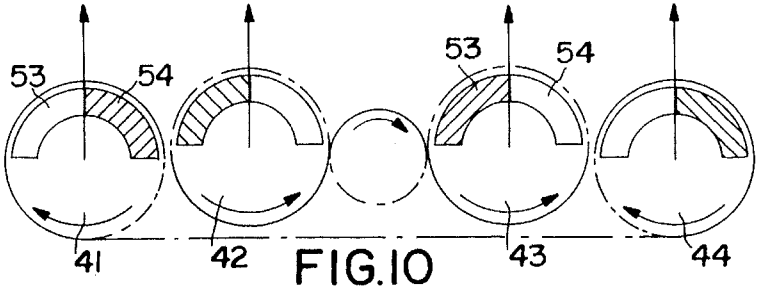
FIG. 10 is a view corresponding to FIG. 9 showing the place of the flyweights on the pulleys with shafts (S1 and S2) in the position depicted in FIG. 9.
Figure 12:
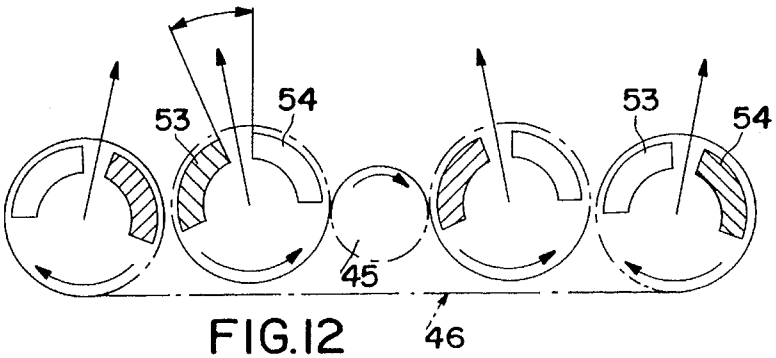
FIG. 12 is a similar view to FIG. 10, but showing the flyweights placed as a function of the position of the shafts (S1 and S2) depicted in FIG. 11.

As shown in FIGS. 10 and 15, the above-mentioned sets of pulleys are mounted on both sides of a support (40) fastened to one or more platforms (1) by any suitable means. The support is designed with holes for drive shafts (S1 and S2) and the pulleys they drive. The first set (T1) comprises pulleys (41, 42, 43 and 44), one of which at least is of the toothed kind, as well as a tensioning roller (45) and a toothed drive belt (46). The second set (T2) comprises pulleys (47, 48, 49 and 50), one of which at least is toothed, as well as a tensioning roller (51) and a toothed drive belt (52). Pulley (42) is keyed on drive shaft (S1), with pulley (48) being mounted idle on the same shaft. Pulley (49) is keyed on drive shaft (S2), with pulley (43) being mounted idle on the same shaft. Each of the pulleys in set (41, 42, 43, 44) and set (47, 48, 49, 50) is equipped with flyweights (53, 54) initially arranged, as shown on FIG. 10, in the same diametric plane and as two juxtaposed cusp-like quarter circles.

Figure 14:
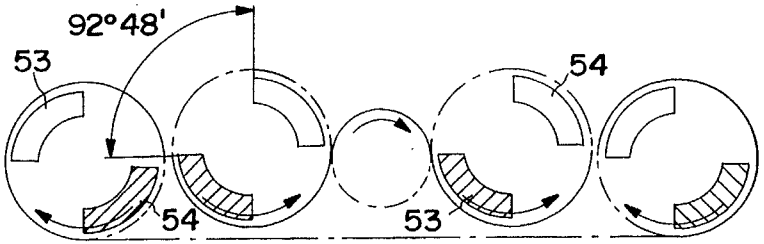
FIG. 14 is a similar view to FIG. 10, showing the flyweights in a position matching that of the shafts in FIG. 13.

Changes in the X–X' and Y–Y' axes will cause them to adopt an angular position with regard to the Z–Z' axis defined by the alignment plane of drive shaft (33) and tensioning roller (34), tending to progressively move flyweights (54) away from flyweights (53) until the former have adopted the position shown in FIG. 14, i.e. fully diametrically opposed to the latter, in which position no vibrational movements will be imparted to the above-mentioned platform(s).

FIG. 16, 17, 18 and 19 show an alternative assembly of the phase-shift device according to the invention.

In actual fact, the device is a twinned version of that described and illustrated in FIG. 6. Here, shafts (S1 and S2) are driven by a single shaft (55) and are complete with two idler rollers each (56, 57) and (58, 59) driven by toothed belts (60, 61). Shafts (S1 and S2) rotate in the same direction and drive shaft (55) in the opposite direction. The two subassemblies (S1, 56, 57) and (S2, 58, 59) can pivot in opposed or in similar angular directions. Shafts (S1 and S2) are each equipped with opposed flyweights. Shafts (S1 and S2), therefore, are coaxial to ensure the phase-shifting of the assemblies on the same shaft.

Figure 17:
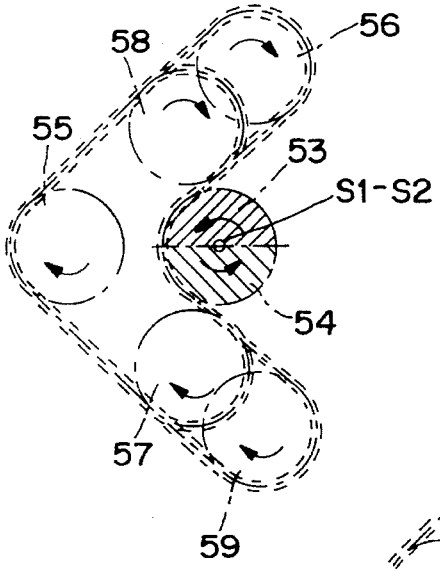
FIGS. 17, 18 and 19 show the principle of operation of the device illustrated in FIG. 16.

FIG. 17 shows a phase-shift angle of 0° and opposed flyweights.

Figure 18:
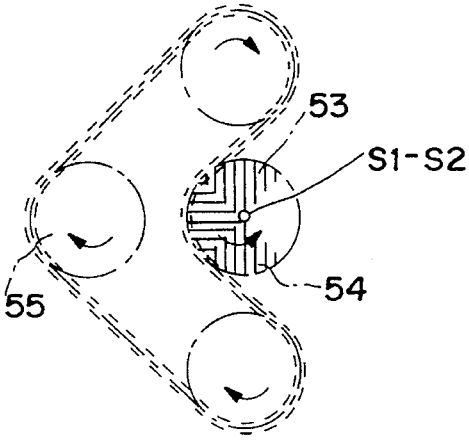

FIG. 18 shows a phase-shift angle of 90° as a result of flyweight repositioning with the two subassemblies in the same plane.

Figure 19:
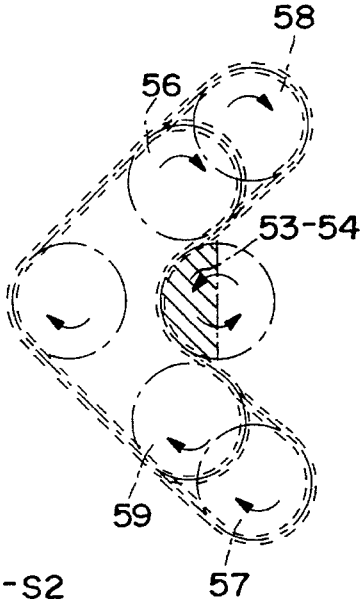

FIG. 19 shows a phase-shift angle of 180°, resulting in flyweight balance and vibrationless operation.

The benefits of the invention are clearly apparent from the description. In the various embodiments described, it becomes clear that setting different oscillating angles will cause a phase-shift between shafts (S1 and S2). This operation can be performed at no load, but its basic benefit is that it can be performed under load. The device, when applied to vibrating equipment, allows the flyweights to be opposed and balanced for vibrationless operation, or to be set for maximum or partial vibration. The drives need no longer be switched off or shut down to stop the equipment vibrating. The device is a particularly interesting one when applied to concrete block manufacturing presses, vibration-type withdrawing belts or screens. The device permits widely different phase-shift angles for only very slight pulley adjustments, which are therefore virtually instantaneous. FIGS. 9 to 14 show the device as applied to a vibrating machine, which is shifted at an angle of 180° for a pulley (35, 36, 37, 38) angle of only 8°.

The assembly featuring drive shafts (S1 and S2) rotating in the same direction is applicable to multidirectional vibrating machines provided they are of the direct-driven type and to unidirectional vibrating machines provided one shaft is direct-driven and the other driven by a reversing pinion drive.

Figure 20:
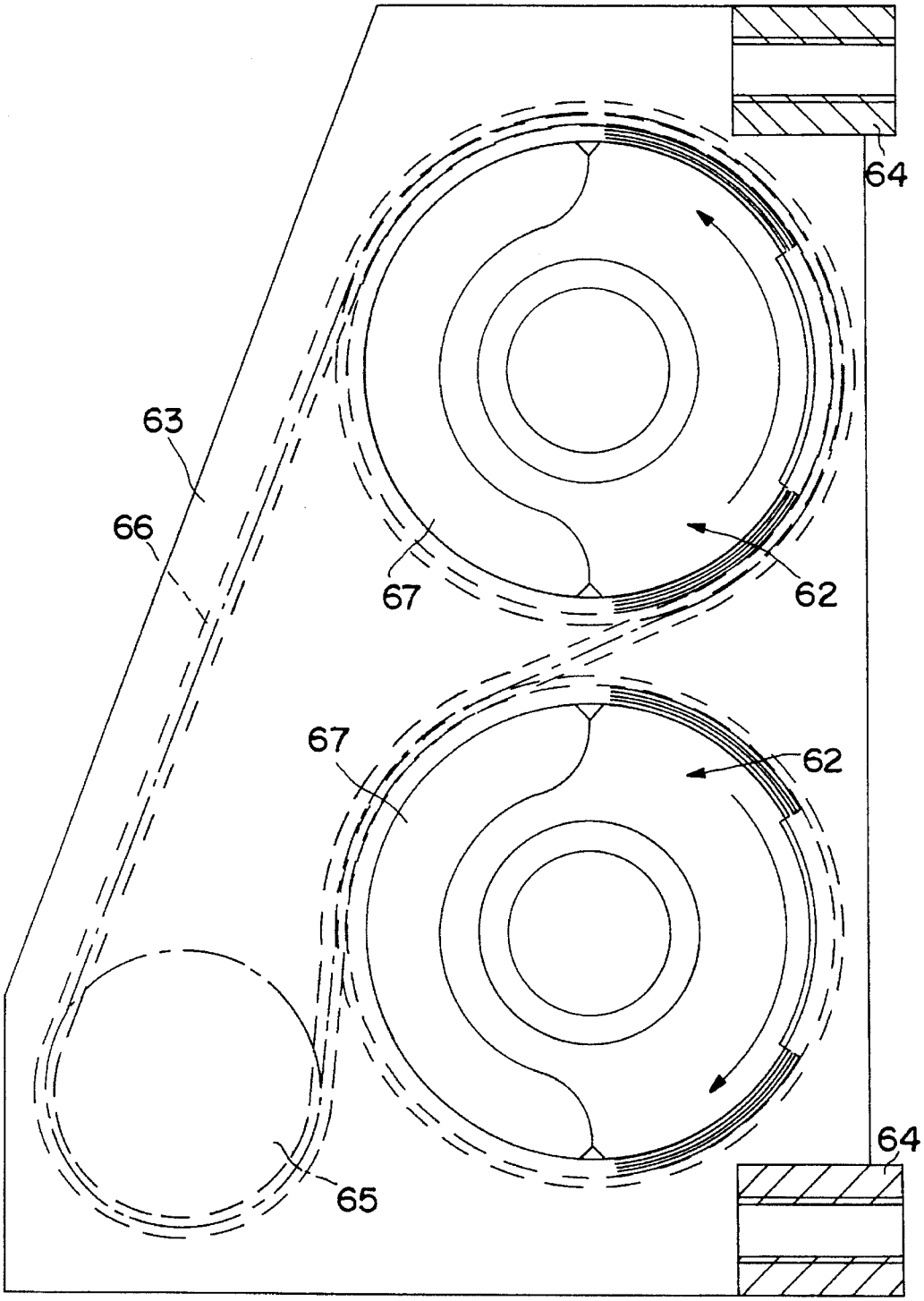
FIG. 20 is an alternative view of the support of the pulleys designed to be equipped with flyweights.

FIG. 20 shows a differing flyweight pulley design. These particular pulleys (62) are installed in a housing (63) that can be mounted on a platform by means (64). The housing fits around an assembly consisting of two pulleys (62), a tensioning roller (65) and a toothed drive belt (66). The pulleys are equipped with permanent, fixed flyweights (67).

FIGS. 21 to 25 show the device according to the invention applied to a vibrating roller or cylinder for tamping and compacting purposes. These figures, therefore, closely resemble the assembly described in FIG. 16 discussed above.

In this embodiment, shafts (S1 and S2) are concentric and coaxial, arranged along the A–A' axis, the so-called drive axis.

Shaft (S1) is a long tube (72) onto which is mounted a shorter, freely rotating sleeve (73). The sleeve turns at a maximum angle of 180° to the tube, which corresponds to the pulley phase-shift and displacement required for opposed action.

Onto this tube (72) and sleeve (73) assembly is mounted the roller or cylinder (87), which is the vibrating element tamping or compacting the material or product it touches. The shaft ends (72.1–72.2) are fitted with pulleys (74, 75) that are equipped with holes (74.1, 75.1) for the flyweights (74.2, 75.2) according to the embodiment described earlier, the pulleys being coupled to said tube (72) as stated. The two pulleys are driven by the above-mentioned tube. In parallel, central sleeve (73) is likewise fitted with a pair of pulleys at each end (76, 77), also equipped with flyweights (76.1, 77.1) and opposed to the pulleys on the tube. Pulleys (74 and 76), installed on the front part of the tube-and-sleeve assembly, are linked by two drive belts (78, 79) and four idler pulleys (80, 81) and (82, 83), while an idler shaft (84) causes the subassemblies to operate simultaneously. The rear part is designed to be protected by a fixed casing (85) in line with the roller or cylinder, whereas the front part of the device is designed to be housed in a receptacle or casing (86) to protect the pulley sets and the phase-shift device. Said pulley assembly (80, 81) is also mounted onto the above-mentioned double flange unit (24), which can be articulated and controlled as to rotation by a jack (V) of the type described above and a stop jack (70). The assembly obtained in this embodiment is extremely compact.

The device according to the invention is applicable to roller or cylinder-type (87) compactors or tamping devices.

Figure 26:
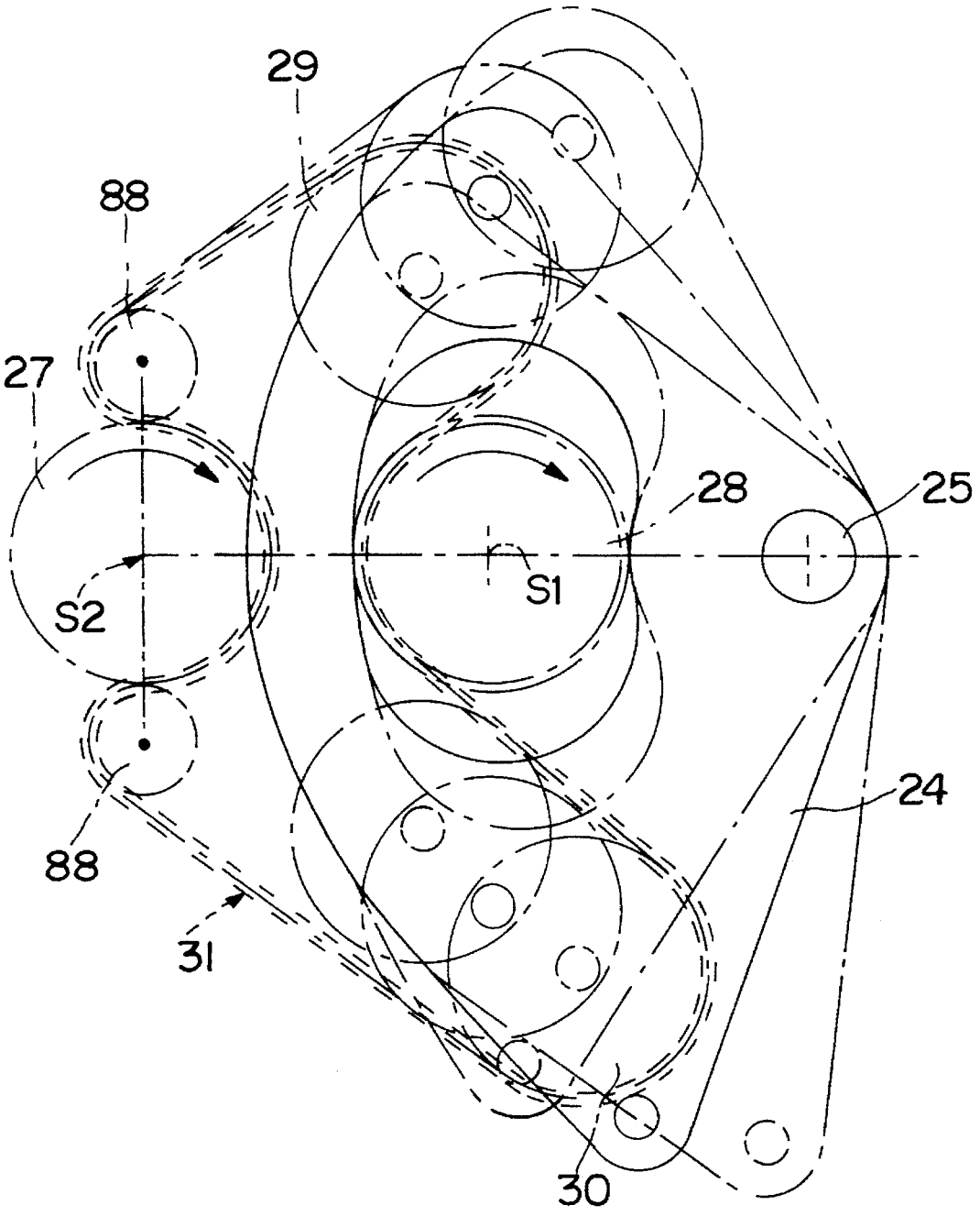
FIG. 26 is a complementary view to FIG. 5 showing the phase-shift device with drive shafts (S1 and S2) rotating in the same direction.

FIG. 26 shows an alternative version of the phase-shift device using the various means depicted in FIG. 5. Shafts (S1 and S2) rotate in the same direction which is achieved by using complementary rollers (88, 89) as guides for belt (31).

The invention is applicable for example to machines and equipment used in the concrete block manufacturing industry. The phase-shift device used in combination with the vibration mechanism can be used for any type of machine or equipment designed to receive products and be vibrated in the processing stage.

I claim:

1. Device controlling vibrations imparted to machines of the type comprising a vibration generator equipped with pulleys having flyweights and rotated by drive shafts wherein the vibration generator has a first, second, third and fourth pulley, the first and second pulley being linked by a first belt, the third and fourth pulley being linked by a second belt, the pulleys being operable to accept flyweights fitted only to a aliametric part thereof, the first and third pulley being mounted on a first shaft, the second and fourth pulley being mounted on a second shaft, the first and second shafts being connected to a phase-shift device designed to cause certain of the pulleys to rotate, thus changing an angular position of the corresponding flyweights, and generating, depending upon said position of the flyweights selected, maximum, partial and minimum vibration with no unwanted torque, one of the shafts being driven by a motor running continuously regardless of the operating phase, and wherein the flyweights can be in static and dynamic equilibrium when the position for minimum vibration is selected; and wherein each of the first and second shafts has both a keyed pulley and art idle pulley, thus forming an alternating and opposed system of pulleys with each pair of pulleys linked by a belt driving a keyed pulley on one shaft and an idle pulley on one shaft.

2. Device as claimed in claim 1, wherein the pulleys are formed with a plurality of radially and angularly distributed holes, into some of which a flyweight is placed on a same diametric side.

3. Device as claimed in claim 1, further comprising a vibrating platform having a top and bottom part in relation to a frame and designed to receive a product to be vibrated on the top part and a vibrator fitted with said pulleys in the bottom part, the vibration generator being located under the vibrating platform, wherein the pulleys are mounted onto a support installed crosswise in the frame, the frame being designed with holes for shafts of said pulleys and a roller connected to each pair of pulleys, a twin pulley and roller set being mounted on either side of the support and the support being equipped with means to attach it to the bottom part of the platform.

4. Device as claimed in claim 1, wherein the shafts rotate in opposite directions.

5. Device as claimed in claim 1, wherein the shafts rotate in a same direction.

6. Device as claimed in claim 1 wherein the first and second shafts connected to the phase-shift device have extensions coupled by any additional coupling means to a double flange unit, said -double flange unit pivoting around a third shaft attached to a protective housing of said phase-shift device, said double flange unit comprising between two flanges, two rollers, said flanges being spaced to accommodate a fixed pulley mounted onto the first shaft, a fifth pulley being mounted on the second shaft in line with the fixed pulley, the fixed and fifth pulleys being fixed in place on their respective shafts, a toothed belt linking said pulleys and rollers, the angular pivoting of the double flange unit causing the phase-shifting of the first and second shafts in relation to each other and the rotation of the first shaft in turn rotating the keyed pulley(s) of the vibration generator.

7. Device as claimed in claim 6, wherein the double flange unit has an axis of rotation lying outside a plane defined by the fixed and fifth pulleys and wherein the double flange unit comprises two triangular flanges, the rollers being located at its two corners, the fixed pulley being situated in a space between an oblong slot in the flanges, whereas the fifth pulley is mounted outside the double flange unit in line with the fixed pulley, said double flange unit being moved by a first jack, the body of which is connected to the protective housing of the device.

8. Device as claimed in claim 7, wherein the double flange unit can be pivoted at an angle limited by an adjustable stop determining the phase-shift angle.

9. Device as claimed in claim 8, wherein the stop comprises a cross-mounted rod between the flanges of the double flange unit, said stop being linked to a profiled part hingedly mounted relative to the double flange unit and about its rotational axis, said profiled part being moved by a second jack mounted onto the protective housing.

10. Device as claimed in claim 9, wherein oscillating the double flange unit at an angle of plus or minus 12.75° causes a phase-shift angle of 180° of the pulleys equipped with flyweights.

11. Device as claimed in claim 5, wherein the phase-shift device comprises a drive pulley, a first tensioning roller and four idle rollers equipped with a toothed belt, and in two of the four idle rollers are mounted in the same plane as the first shaft along an X–X' axis, whereas the remaining two of the four idle rollers are mounted in the same plane as the second shaft along an Y–Y' axis with the drive pulley and first tensioning roller being aligned along a Z–Z' axis, the first and second shafts drive two sets of four pulleys bearing the flyweights.

12. Device as claimed in claim 11, wherein the two sets of pulleys are mounted on both sides of a support fastened to the platform, said support being equipped with holes for the first and second shafts and the pulleys they drive fitted with flyweights, the first set comprising four pulleys, one of which at least is of a toothed kind as well as a second tensioning roller, the second set also comprising four pulleys, one of which at least is toothed, as well as a third tensioning roller, and a toothed drive belt, certain of the pulleys being keyed on the first and second drive shafts and certain others of the pulleys being mounted idle on the first and second.

13. Device as claimed in claim 12, wherein the two sets of pulleys are fitted with flyweights, and in that changes in the X–X' and Y–Y' axes will cause the flyweights to progressively move away until they are diametrically opposed.

14. Device as claimed in claim 4, wherein the first and second shafts are driven by a single drive shaft and have two idler rollers each driven by two belts, it being possible to pivot the two subassemblies, the first shaft, and two idle rollers and the second shaft, and two idle rollers) in opposed or in similar angular directions, the first and second shafts being coaxial to ensure the phase-shifting of the assemblies on the same shaft.

15. Device as claimed in claim 4, further comprising one of a vibrating roller and cylinder for tamping or compacting purposes, the first and second shafts being concentric and coaxial, the first shaft comprising a long tube onto which is mounted a shorter sleeve, the sleeve and the tube turning at a maximum angle of 180° in relation to each other which corresponds to a pulley phase-shift, and onto the long tube and sleeve assembly is mounted a roller, the roller forming a vibrating element, and wherein said tube is fitted with a pair of pulleys at each end, equipped with flyweights, the central sleeve being likewise fitted with a pair of pulleys at each end, also being equipped with flyweights and opposed to the pulleys, the pulleys being linked by two drive belts with four idler pulleys and, an idler shaft causing the two subassemblies to operate.

16. Device as claimed in claim 15, wherein a first casing is in line with the roller or cylinder to protect the pulleys at a rear of the first and second shafts, and a second casing protects the pulleys at the from of the first and second shafts and the phase-shift device, said pulleys being mounted onto a double flange unit articulated and controlled as to angular orientation by the first and second jacks.

17. Device as claimed in claim 6, wherein the first and second shafts rotate in a same direction, complementary rollers being used as guides for the belt.

18. Use of the device as claimed in claim 1 for concrete block manufacturing.

19. Use of the device as claimed in claim 1 for any type of vibrating or compacting machine or equipment.

20. Use of the device as claimed in claim 15, for compacting rollers.

21. Device as claimed in claim 16, the device being applicable to compacting rollers.

* * * * *